US010431226B2

(12) United States Patent
Faure et al.

(10) Patent No.: US 10,431,226 B2
(45) Date of Patent: Oct. 1, 2019

(54) FRAME LOSS CORRECTION WITH VOICE INFORMATION

(71) Applicant: ORANGE, Paris (FR)

(72) Inventors: Julien Faure, Ploubezre (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 56 days.

(21) Appl. No.: 15/303,405

(22) PCT Filed: Apr. 24, 2015

(86) PCT No.: PCT/FR2015/051127
§ 371 (c)(1),
(2) Date: Oct. 11, 2016

(87) PCT Pub. No.: WO2015/166175
PCT Pub. Date: Nov. 5, 2015

(65) Prior Publication Data

US 2017/0040021 A1 Feb. 9, 2017

(30) Foreign Application Priority Data

Apr. 30, 2014 (FR) ..... 14 53912

(51) Int. Cl.
*G10L 19/20* (2013.01)
*G10L 25/81* (2013.01)
(Continued)

(52) U.S. Cl.
CPC ..... *G10L 19/005* (2013.01); *G10L 19/028* (2013.01); *G10L 25/81* (2013.01); *G10L 19/20* (2013.01); *G10L 2025/932* (2013.01)

(58) Field of Classification Search
CPC ... G10L 19/005; G10L 19/093; G10L 19/028; G10L 2025/932; G06F 11/1492
(Continued)

(56) References Cited

U.S. PATENT DOCUMENTS 5,504,833 A * 4/1996 George ..... G10L 19/02 704/203
5,799,271 A * 8/1998 Byun ..... G10L 19/08 704/207

(Continued)

FOREIGN PATENT DOCUMENTS

FR 3 001 593 A1 8/2014
WO 2008/072913 A1 6/2008
WO 2010/127617 A1 11/2010

OTHER PUBLICATIONS

Lindblom, Jonas, et al. "Packet loss concealment based on sinusoidal extrapolation." Acoustics, Speech, and Signal Processing (ICASSP), 2002 IEEE International Conference on. vol. 1. IEEE, May 2002, pp. 173-176.*

(Continued)

*Primary Examiner* — James S Wozniak
(74) *Attorney, Agent, or Firm* — Drinker Biddle & Reath LLP

(57) ABSTRACT

A method for processing a digital audio signal, including a series of samples distributed in consecutive frames, is implemented when decoding the signal in order to replace at least one signal frame lost during decoding. The method includes the following steps: a) searching, in a valid signal segment available when decoding, for at least one period in the signal, determined in accordance with the valid signal; b) analyzing the signal in the period, in order to determine spectral components of the signal in the period; c) synthesizing at least one frame for replacing the lost frame, by construction of a synthesis signal from: an addition of components selected among the predetermined spectral components, and a noise added to the addition of components. In particular, the amount of noise added to the addition of components is weighted in accordance with
(Continued)

voice information of the valid signal, obtained when decoding.

11 Claims, 4 Drawing Sheets

(51) Int. Cl.
*G10L 25/93* (2013.01)
*G10L 19/005* (2013.01)
*G10L 19/028* (2013.01)

(58) Field of Classification Search
USPC ..... 704/E19.003, 223, 228; 714/747
See application file for complete search history.

(56) References Cited

U.S. PATENT DOCUMENTS 5,956,674 A * 9/1999 Smyth ..... G10L 19/0208 704/200.1
6,138,089 A * 10/2000 Guberman ..... G10L 19/02 704/207
6,233,550 B1 * 5/2001 Gersho ..... G10L 19/10 704/208
6,640,209 B1 * 10/2003 Das ..... G10L 19/18 704/207
6,691,092 B1 * 2/2004 Udaya Bhaskar .... G10L 19/097 704/205
6,912,496 B1 * 6/2005 Bhattacharya ..... G10L 19/087 704/228
2003/0009325 A1 * 1/2003 Kirchherr ..... G10L 19/20 704/211
2003/0028386 A1 * 2/2003 Zinser, Jr. ..... G10L 19/173 704/500
2004/0093206 A1 * 5/2004 Hardwick ..... G10L 19/087 704/221
2005/0060153 A1 * 3/2005 Gable ..... G10L 17/02 704/246
2005/0108004 A1 * 5/2005 Otani ..... G10L 25/78 704/205
2006/0149539 A1 * 7/2006 Van Schijndel ..... G10L 19/093 704/222
2006/0165239 A1 * 7/2006 Langner ..... G10L 15/02 381/56
2006/0165240 A1 * 7/2006 Bloom ..... G10H 1/366 381/56
2006/0265216 A1 * 11/2006 Chen ..... G10L 19/005 704/228
2007/0027681 A1 * 2/2007 Kim ..... G10L 25/93 704/208
2008/0027711 A1 * 1/2008 Rajendran ..... G10L 19/167 704/201
2009/0076808 A1 * 3/2009 Xu ..... G10L 19/005 704/207
2009/0180531 A1 * 7/2009 Wein ..... G10L 19/08 375/240
2009/0326942 A1 * 12/2009 Fulop ..... G10L 17/02 704/246
2011/0035213 A1 * 2/2011 Malenovsky ..... G10L 25/78 704/208
2011/0125505 A1 * 5/2011 Vaillancourt ..... G10L 19/005 704/500
2014/0088968 A1 * 3/2014 Chen ..... G10L 13/08 704/254
2015/0228288 A1 * 8/2015 Subasingha ..... G10L 19/0204 704/500
2015/0265206 A1 * 9/2015 Sheinkopf ..... G10L 25/66 600/586
2015/0317994 A1 * 11/2015 Ramadas ..... G10L 19/24 704/226
2015/0371647 A1 12/2015 Faure et al.
2017/0040021 A1 * 2/2017 Faure ..... G10L 19/20

OTHER PUBLICATIONS

Lindblom, Jonas. "A sinusoidal voice over packet coder tailored for the frame-erasure channel." IEEE Transactions on Speech and Audio Processing 13.5, Sep. 2005, pp. 787-798.*
Nakamura, K., et al. "An improvement of G. 711 PLC using sinusoidal model." Computer as a Tool, 2005. EUROCON 2005. The International Conference on. vol. 2. IEEE, Nov. 2005, pp. 1670-1673.*
Rodbro, C. A., et al. "Compressed domain packet loss concealment of sinusoidally coded speech." Acoustics, Speech, and Signal Processing, 2003. Proceedings.(ICASSP'03). 2003 IEEE International Conference on. vol. 1. IEEE, May 2003, pp. 1-5.*
International Telecommunication Union, "Pulse code modulation (PCM) of voice frequencies; Appendix I: A high quality low-complexity algorithm for packet loss concealment with G.711," ITU-T Standard, No. G.711, Appendix I, Geneva, CH, Sep. 1999, pp. 1-26.
Parikh et al., "Frame Erasure Concealment Using Sinusoidal Analysis-Synthesis and Its Application to MDCT-Based Codecs," 2000 IEEE International Conference on Acoustics, Speech, and Signal Processing, 2000, ICASSP'00, Jun. 5-9, 2000, Piscataway, NJ, USA, IEEE, Jun. 5, 2000, vol. 2, pp. 905-908.
Ryu et al., "Advances in Sinusoidal Analysis/Synthesis-based Error Concealment in Audio Networking," Preprints of Papers presented at AES 116th Convention, Berlin, Germany, May 8, 2004, paper 5997, pp. 1-11.

* cited by examiner

FRAME LOSS CORRECTION WITH VOICE INFORMATION

CROSS-REFERENCE TO RELATED APPLICATIONS

This application is the U.S. national phase of the International Patent Application No. PCT/FR2015/051127 filed Apr. 24, 2015, which claims the benefit of French Application No. 14 53912 filed Apr. 30, 2014, the entire content of which is incorporated herein by reference.

BACKGROUND

The present invention relates to the field of encoding/decoding in telecommunications, and more particularly to the field of frame loss correction in decoding.

A "frame" is an audio segment composed of at least one sample (the invention applies to the loss of one or more samples in coding according to G.711 as well as to a loss one or more packets of samples in coding according to standards G.723, G.729, etc.).

Losses of audio frames occur when a real-time communication using an encoder and a decoder is disrupted by the conditions of a telecommunications network (radiofrequency problems, congestion of the access network, etc.). In this case, the decoder uses frame loss correction mechanisms to attempt to replace the missing signal with a signal reconstructed using information available at the decoder (for example the audio signal already decoded for one or more past frames). This technique can maintain a quality of service despite degraded network performance.

Frame loss correction techniques are often highly dependent on the type of coding used.

In the case of CELP coding, it is common to repeat certain parameters decoded in the previous frame (spectral envelope, pitch, gains from codebooks), with adjustments such as modifying the spectral envelope to converge toward an average envelope or using a random fixed codebook.

In the case of transform coding, the most widely used technique for correcting frame loss consists of repeating the last frame received if a frame is lost and setting the repeated frame to zero as soon as more than one frame is lost. This technique is found in many coding standards (G.719, G.722.1, G.722.1C). One can also cite the case of the G.711 coding standard, for which an example of frame loss correction described in Appendix I to G.711 identifies a fundamental period (called the "pitch period") in the already decoded signal and repeats it, overlapping and adding the already decoded signal and the repeated signal ("overlap-add"). Such overlap-add "erases" audio artifacts, but in order to be implemented requires an additional delay in the decoder (corresponding to the duration of the overlap).

Moreover, in the case of coding standard G.722.1, a modulated lapped transform (or MLT) with an overlap-add of 50% and sinusoidal windows ensures a transition between the last lost frame and the repeated frame that is slow enough to erase artifacts related to simple repetition of the frame in the case of a single lost frame. Unlike the frame loss correction described in the G.711 standard (Appendix I), this embodiment requires no additional delay because it makes use of the existing delay and the temporal aliasing of the MLT transform to implement an overlap-add with the reconstructed signal.

This technique is inexpensive, but its main fault is an inconsistency between the signal decoded before the frame loss and the repeated signal. This results in a phase discontinuity that can produce significant audio artifacts if the duration of the overlap between the two frames is low, as is the case when the windows used for the MLT transform are "short delay" as described in document FR 1350845 with reference to FIGS. 1A and 1B of that document. In such case, even a solution combining a pitch search as in the case of the coder according to standard G.711 (Appendix I) and an overlap-add using the window of the MLT transform is not sufficient to eliminate audio artifacts.

Document FR 1350845 proposes a hybrid method that combines the advantages of both these methods to keep phase continuity in the transformed domain. The present invention is defined within this framework. A detailed description of the solution proposed in FR 1350845 is described below with reference to FIG. 1.

Although it is particularly promising, this solution requires improvement because, when the encoded signal has only one fundamental period ("mono pitch"), for example in a voiced segment of a speech signal, the audio quality after frame loss correction may be degraded and not as good as with frame loss correction by a speech model of a type such as CELP ("Code-Excited Linear Prediction").

SUMMARY

The invention improves the situation.

For this purpose, it proposes a method for processing a digital audio signal comprising a series of samples distributed in successive frames, the method being implemented when decoding said signal in order to replace at least one lost signal frame during decoding.

The method comprises the steps of:

a) searching, in a valid signal segment available when decoding, for at least one period in the signal, determined based on said valid signal, b) analyzing the signal in said period, in order to determine spectral components of the signal in said period, c) synthesizing at least one replacement for the lost frame, by constructing a synthesis signal from:

an addition of components selected from among said determined spectral components, and noise added to the addition of components.

In particular, the amount of noise added to the addition of components is weighted based on voice information of the valid signal, obtained when decoding.

Advantageously, the voice information used when decoding, transmitted at at least one bitrate of the encoder, gives more weight to the sinusoidal components of the passed signal if this signal is voiced, or gives more weight to the noise if not, which yields a much more satisfactory audible result. However, in the case of an unvoiced signal or in the case of a music signal, it is unnecessary to keep so many components for synthesizing the signal replacing the lost frame. In this case, more weight can be given to the noise injected for the synthesis of the signal. This advantageously reduces the complexity of the processing, particularly in the case of an unvoiced signal, without degrading the quality of the synthesis.

In an embodiment in which a noise signal is added to the components, this noise signal is therefore weighted by a smaller gain in the case of voicing in the valid signal. For example, the noise signal may be obtained from the previously received frame by a residual between the received signal and the addition of selected components.

In an additional or alternative embodiment, the number of components selected for the addition is larger in the case of voicing in the valid signal. Thus, if the signal is voiced, the spectrum of the passed signal is given more consideration, as indicated above.

Advantageously, a complementary form of embodiment may be chosen in which more components are selected if the signal is voiced, while minimizing the gain to be applied to the noise signal. Thus, the total amount of energy attenuated by applying a gain of less than 1 to the noise signal is partially offset by the selection of more components. Conversely, the gain to be applied to the noise signal is not decreased and fewer components are selected if the signal is not voiced or is weakly voiced.

In addition, it is possible to further improve the compromise between quality/complexity in decoding, and in step a) the above period may be searched for in a valid signal segment of greater length, in the case of voicing in a valid signal. In an embodiment presented in the detailed description below, a search is made by correlating, in the valid signal, a period of repetition typically corresponding to at least one pitch period if the signal is voiced, and in this case, particularly for male voices, the pitch search may be carried out over more than 30 milliseconds for example.

In an optional embodiment, the voice information is supplied in an encoded stream ("bitstream") received in decoding and corresponding to said signal comprising a series of samples distributed in successive frames. In the case of frame loss in decoding, the voice information contained in a valid signal frame preceding the lost frame is then used.

The voice information thus comes from an encoder generating a bitstream and determining the voice information, and in one particular embodiment the voice information is encoded in a single bit in the bitstream. However, as an exemplary embodiment, the generation of this voice data in the encoder may be dependent on whether there is sufficient bandwidth on a communication network between the encoder and the decoder. For example, if the bandwidth is below a threshold, the voice data is not transmitted by the encoder in order to save bandwidth. In this case, purely as an example, the last voice information acquired at the decoder can be used for the frame synthesis, or alternatively it may be decided to apply the unvoiced case for the synthesis of the frame.

In implementation, the voice information is encoded in one bit in the bitstream, the value of the gain applied to the noise signal may also be binary, and if the signal is voiced, the gain value is set to 0.25 and otherwise is 1.

Alternatively, the voice information comes from an encoder determining a value for the harmonicity or flatness of the spectrum (obtained for example by comparing amplitudes of the spectral components of the signal to a background noise), the encoder then delivering this value in binary form in the bitstream (using more than one bit).

In such an alternative, the gain value may be determined as a function of said flatness value (for example continuously increasing as a function of this value).

Generally, said flatness value can be compared to a threshold in order to determine:

that the signal is voiced if the flatness value is below the threshold, and that the signal is unvoiced otherwise, (which characterizes voicing in a binary manner).

Thus, in the single bit implementation as well as its variant, the criteria for selecting components and/or choosing the duration of the signal segment in which the pitch search occurs may be binary.

For example, for the selection of components:

if the signal is voiced, the spectral components having amplitudes greater than those of the neighboring first spectral components are selected, as well as the neighboring first spectral components, and otherwise, only the spectral components having amplitudes greater than those of the neighboring first spectral components are selected.

For selecting the duration of the pitch search segment, for example:

if the signal is voiced, the period is searched for in a valid signal segment of a duration of more than 30 milliseconds (for example 33 milliseconds), and if not, the period is searched for in a valid signal segment of a duration of less than 30 milliseconds (for example 28 milliseconds).

Thus, the invention aims to improve the prior art in the sense of document FR 1350845 by modifying various steps in the processing presented in that document (pitch search, selection of components, noise injection), but is still based in particular on characteristics of the original signal.

These characteristics of the original signal can be encoded as special information in the data stream to the decoder (or "bitstream"), according to the speech and/or music classification, and if appropriate on the speech class in particular.

This information in the bitstream at decoding allows optimizing the compromise between quality and complexity, and, collectively:

changing the gain of the noise to be injected into the sum of the selected spectral components in order to construct the synthesis signal replacing the lost frame, changing the number of components selected for the synthesis, changing the duration of the pitch search segment.

Such an embodiment may be implemented in an encoder for the determination of voice information, and more particularly in a decoder, for the case of frame loss. It may be implemented as software to carry out encoding/decoding for the enhanced voice services (or "EVS") specified by the 3GPP group (SA4).

In this capacity, the invention also provides a computer program comprising instructions for implementing the above method when this program is executed by a processor. An exemplary flowchart of such a program is presented in the detailed description below, with reference to FIG. 4 for decoding and with reference to FIG. 3 for encoding.

The invention also relates to a device for decoding a digital audio signal comprising a series of samples distributed in successive frames. The device comprises means (such as a processor and a memory, or an ASIC component or other circuit) for replacing at least one lost signal frame, by:

a) searching, in a valid signal segment available when decoding, for at least one period in the signal, determined based on said valid signal, b) analyzing the signal in said period, in order to determine spectral components of the signal in said period, c) synthesizing at least one frame for replacing the lost frame, by constructing a synthesis signal from:

an addition of components selected from among said determined spectral components, and noise added to the addition of components, the amount of noise added to the addition of components being weighted based on voice information of the valid signal, obtained when decoding.

Similarly, the invention also relates to a device for encoding a digital audio signal, comprising means (such as a memory and a processor, or an ASIC component or other circuit) for providing voice information in a bitstream delivered by the encoding device, distinguishing a speech signal likely to be voiced from a music signal, and in the case of a speech signal:

identifying that the signal is voiced or generic, in order to consider it as generally voiced, or identifying that the signal is inactive, transient, or unvoiced, in order to consider it as generally unvoiced.

BRIEF DESCRIPTION OF THE DRAWINGS

Other features and advantages of the invention will be apparent from examining the following detailed description and the appended drawings in which.

DETAILED DESCRIPTION

Figure 1:
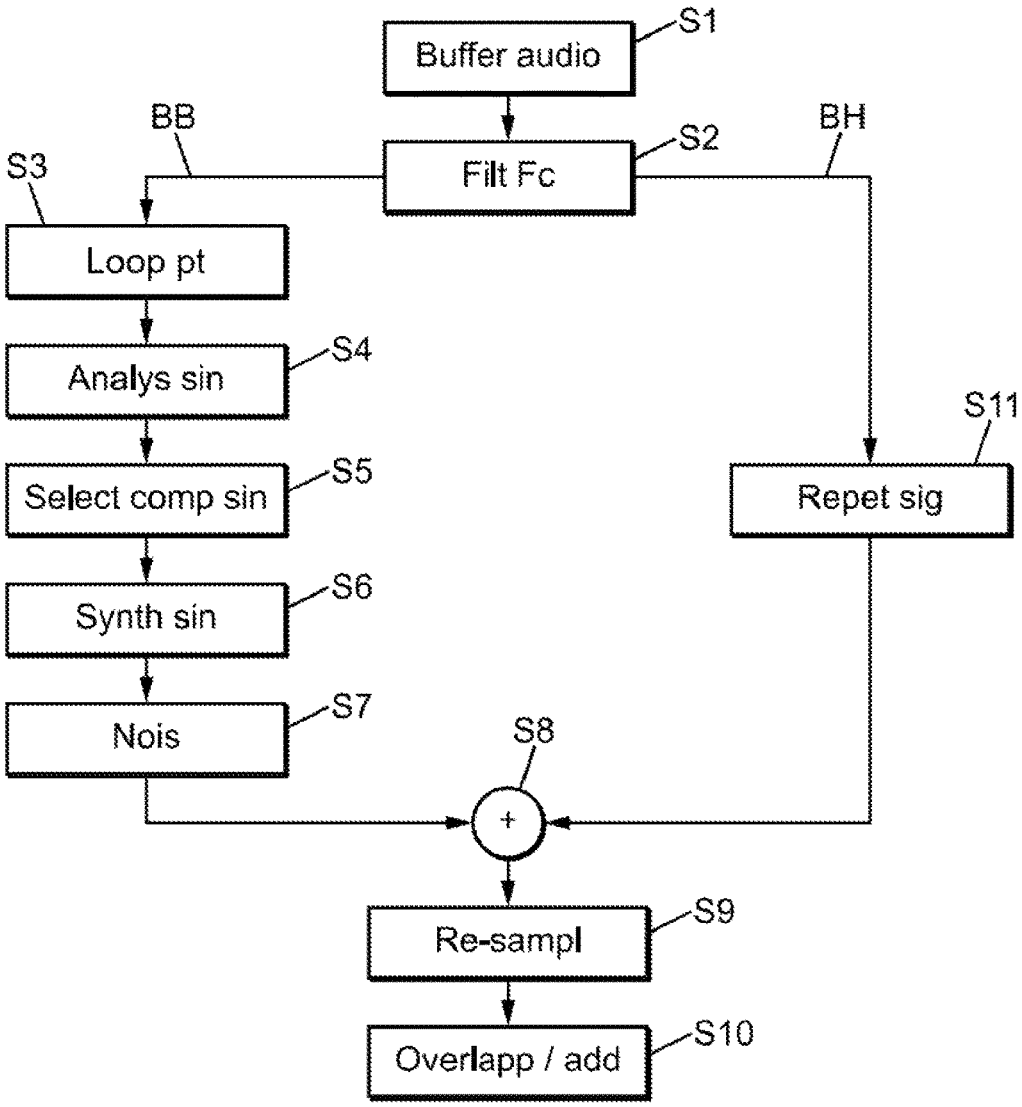
FIG. 1 summarizes the main steps of the method for correcting frame loss in the sense of document FR 1350845.

We now refer to FIG. 1, illustrating the main steps described in document FR 1350845. A series of N audio samples, denoted b(n) below, is stored in a buffer memory of the decoder. These samples correspond to samples already decoded and are therefore accessible for correcting frame loss at the decoder. If the first sample to be synthesized is sample N, the audio buffer corresponds to previous samples 0 to N−1. In the case of transform coding, the audio buffer corresponds to samples in the previous frame, which cannot be changed because this type of encoding/decoding does not provide for delay in reconstructing the signal; therefore the implementation of a crossfade of sufficient duration to cover a frame loss is not provided for.

Next is a step S2 of frequency filtering, in which the audio buffer b(n) is divided into two bands, a low band LB and a high band HB, with a separation frequency denoted Fc (for example Fc=4 kHz). This filtering is preferably a delayless filtering. The size of the audio buffer is now reduced to N'=N*Fc/f following decimation of fs to Fc. In variants of the invention, this filtering step may be optional, the next steps being carried out on the full band.

The next step S3 consists of searching the low band for a loop point and a segment p(n) corresponding to the fundamental period (or "pitch") within buffer b(n) re-sampled at frequency Fc. This embodiment allows taking into account pitch continuity in the lost frame(s) to be reconstructed.

Step S4 consists of breaking apart segment p(n) into a sum of sinusoidal components. For example, the discrete Fourier transform (DFT) of signal p(n) over a duration corresponding to the length of the signal can be calculated. The frequency, phase, and amplitude of each of the sinusoidal components (or "peaks") of the signal are thus obtained. Transforms other than DFT are possible. For example, transforms such as DCT, MDCT, or MCLT may be applied.

Step S5 is a step of selecting K sinusoidal components in order to retain only the most significant components. In one particular embodiment, the selection of components first corresponds to selecting the amplitudes A(n) for which A(n)>A(n−1) and A(n)>A(n+1) where $$n \in \left[0; \frac{P'}{2} - 1\right],$$

which ensures that the amplitudes correspond to spectral peaks.

To do this, the samples of segment p(n) (pitch) are interpolated to obtain segment p'(n) composed of P' samples, where $P'=2^{ceil(log_2(P))}>P$, ceil(x) being an integer greater than or equal to x. Analysis by Fourier transform FFT is therefore done more efficiently over a length which is a power of 2, without modifying the actual pitch period (due to the interpolation). The FFT transform of p'(n) is calculated: Π(k)=FFT(p'(n)); and, from the FFT transform, the phases φ(k) and amplitudes A(k) of the sinusoidal components are directly obtained, the normalized frequencies between 0 and 1 being given here by:

$$f(k) = \frac{2kP'}{P^2} \quad k \in \left[0; \frac{P'}{2} - 1\right]$$

Next, among the amplitudes of this first selection, the components are selected in descending order of amplitude, so that the cumulative amplitude of the selected peaks is at least x % (for example x=70%) of the cumulative amplitude over typically half the spectrum at the current frame.

In addition, it is also possible to limit the number of components (for example to 20) in order to reduce the complexity of the synthesis.

The sinusoidal synthesis step S6 consists of generating a segment s(n) of a length at least equal to the size of the lost frame (T). The synthesis signal s(n) is calculated as a sum of the selected sinusoidal components:

$$s(n) = \sum_{k=0}^{k=K} A(k)\sin(\pi f(k)n + \varphi(k)) \quad n \in \left[0; 2T + \frac{LF}{2}\right]$$

where k is the index of the K peaks selected in step S5.

Step S7 consists of "noise injection" (filling in the spectral regions corresponding to the lines not selected) in order to compensate for energy loss due to the omission of certain frequency peaks in the low band. One particular implementation consists of calculating the residual r(n) between the segment corresponding to the pitch p(n) and the synthesis signal s(n), where n∈[0; P−1], such that:

$$r(n)=p(n)-s(n) n \in [0;P-1]$$

This residual of size P is transformed, for example it is windowed and repeated with overlaps between windows of varying sizes, as described in patent FR 1353551:

$$r'(k) = f(r(n)) \quad n \in [0; P-1] \text{ et } k \in \left[0; 2T + \frac{LF}{2}\right]$$

Signal s(n) is then combined with signal r'(n):

$$s(n) = s(n) + r'(n) \quad n \in \left[0; 2T + \frac{LF}{2}\right]$$

Step S8 applied to the high band may simply consist of repeating the passed signal.

In step S9, the signal is synthesized by resampling the low band at its original frequency fc, after having been mixed with the filtered high band in step S8 (simply repeated in step S11).

Step S10 is an overlap-add to ensure continuity between the signal before the frame loss and the synthesis signal.

We now describe elements added to the method of FIG. 1, in one embodiment in the sense of the invention.

Figure 2:
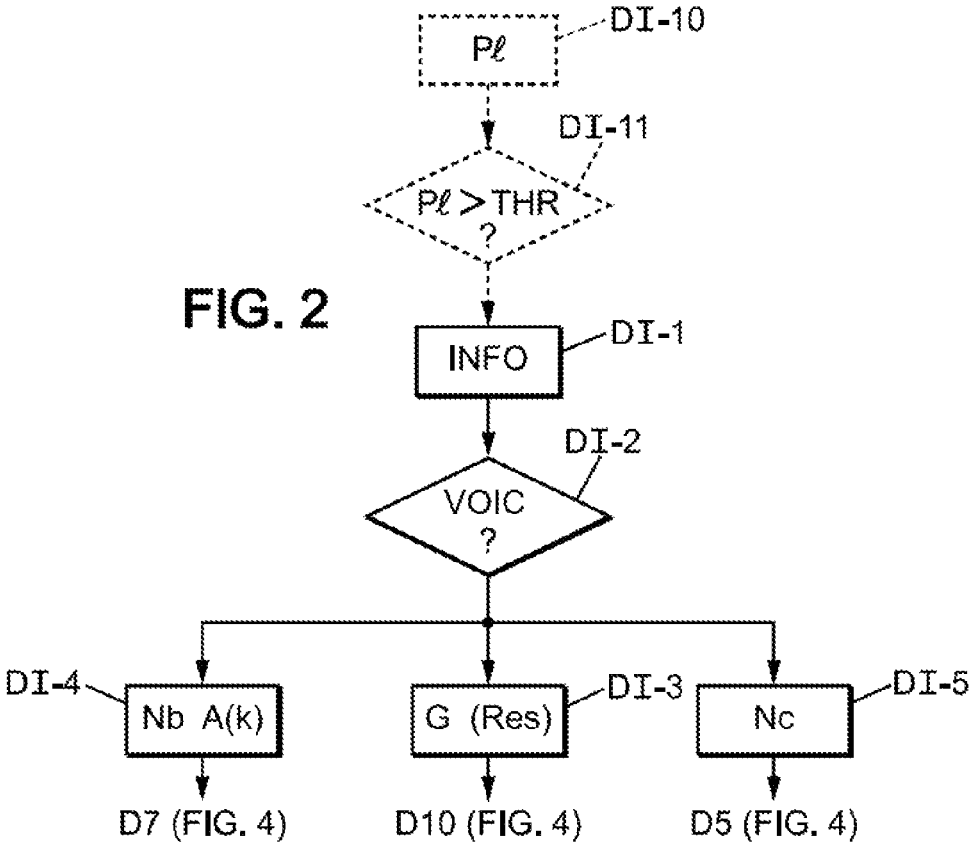
FIG. 2 schematically shows the main steps of a method according to the invention.

According to a general approach presented in FIG. 2, voice information of the signal before frame loss, transmitted at at least one bitrate of the coder, is used in decoding (step DI-1) in order to quantitatively determine a proportion of noise to be added to the synthesis signal replacing one or more lost frames. Thus, the decoder uses the voice information to decrease, based on the voicing, the general amount of noise mixed in the synthesis signal (by assigning a gain G(res) lower than the noise signal r'(k) originating from a residual in step DI-3, and/or by selecting more components of amplitudes A(k) for use in constructing the synthesis signal in step DI-4).

In addition, the decoder may adjust its parameters, particularly for the pitch search, to optimize the compromise between quality/complexity of the processing, based on the voice information. For example, for the pitch search, if the signal is voiced, the pitch search window Nc may be larger (in step DI-5), as we will see below with reference to FIG. 5.

For determining the voicing, information may be provided by the encoder, in two ways, at at least one bitrate of the encoder:

- in the form of a bit of value 1 or 0 depending on a degree of voicing identified in the encoder (received from the encoder in step DI-1 and read in step DI-2 in case of frame loss for the subsequent processing), or
- as a value of the average amplitude of the peaks composing the signal in encoding, compared to a background noise.

This spectrum "flatness" data Pl may be received in multiple bits at the decoder in optional step DI-10 of FIG. 2, then compared to a threshold in step DI-11, which is the same as determining in steps DI-1 and DI-2 whether the voicing is above or below a threshold, and deducing the appropriate processing, particularly for the selection of peaks and for the choice of length of the pitch search segment.

This information (whether in the form of a single bit or as a multi-bit value) is received from the encoder (at at least one bitrate of the codec), in the example described here.

Figure 3:
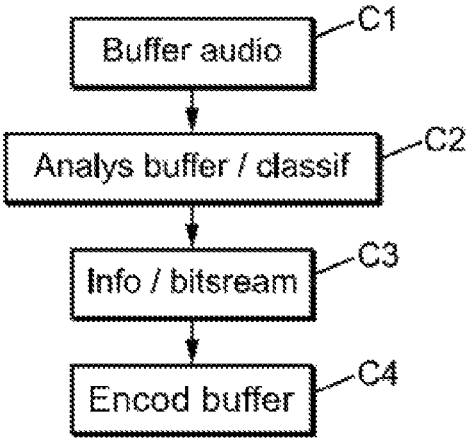
FIG. 3 illustrates an example of steps implemented in encoding, in one embodiment in the sense of the invention.

Indeed, with reference to FIG. 3, in the encoder, the input signal presented in the form of frames C1 is analyzed in step C2. The analysis step consists of determining whether the audio signal of the current frame has characteristics that require special processing in case of frame loss at the decoder, as is the case for example with voiced speech signals.

In one particular embodiment, a classification (speech/music or other) already determined at the encoder is advantageously used in order to avoid increasing the overall complexity of the processing. Indeed, in the case of encoders that can switch coding modes between speech or music, classification at the encoder already allows adapting the encoding technique employed to the nature of the signal (speech or music). Similarly, in the case of speech, predictive encoders such as the encoder of the G.718 standard also use classification in order to adapt the encoder parameters to the type of signal (sounds that are voiced/unvoiced, transient, generic, inactive).

In one particular first embodiment, only one bit is reserved for "frame loss characterization." It is added to the encoded stream (or "bitstream") in step C3 to indicate whether the signal is a speech signal (voiced or generic). This bit is, for example, set to 1 or 0 according to the following table, based on:

the decision of the speech/music classifier and also on the decision of the speech coding mode classifier.

| Decision of the encoder's classifier | Speech | | Music |
|---|---|---|---|
| Value of frame loss characterization bit | Decision of the coding mode classifier: | | 0 |
| | Voiced | 1 | |
| | Not voiced | 0 | |
| | Transient | 0 | |
| | Generic | 1 | |
| | Inactive | 0 | |

Here, the term "generic" refers to a common speech signal (which is not a transient related to the pronunciation of a plosive, is not inactive, and is not necessarily purely voiced such as the pronunciation of a vowel without a consonant).

In a second alternative embodiment, the information transmitted to the decoder in the bitstream is not binary but corresponds to a quantification of the ratio between the peaks and valleys in the spectrum. This ratio can be expressed as a measurement of the "flatness" of the spectrum, denoted Pl:

$$Pl = \log^2\left(\frac{\exp\left(\frac{1}{N}\sum_{k=0}^{N-1}\ln(x(k))\right)}{\frac{1}{N}\sum_{k=0}^{N-1}x(k)}\right)$$

In this expression, x(k) is the spectrum of amplitude of size N resulting from analysis of the current frame in the frequency domain (after FFT).

In an alternative, a sinusoidal analysis is provided, breaking down the signal at the encoder into sinusoidal components and noise, and the flatness measurement is obtained by a ratio of sinusoidal components and the total energy of the frame.

After step C3 (including the one bit of voice information or the multiple bits of the flatness measurement), the audio buffer of the encoder is conventionally encoded in step C4 before any subsequent transmission to the decoder.

Figure 4:
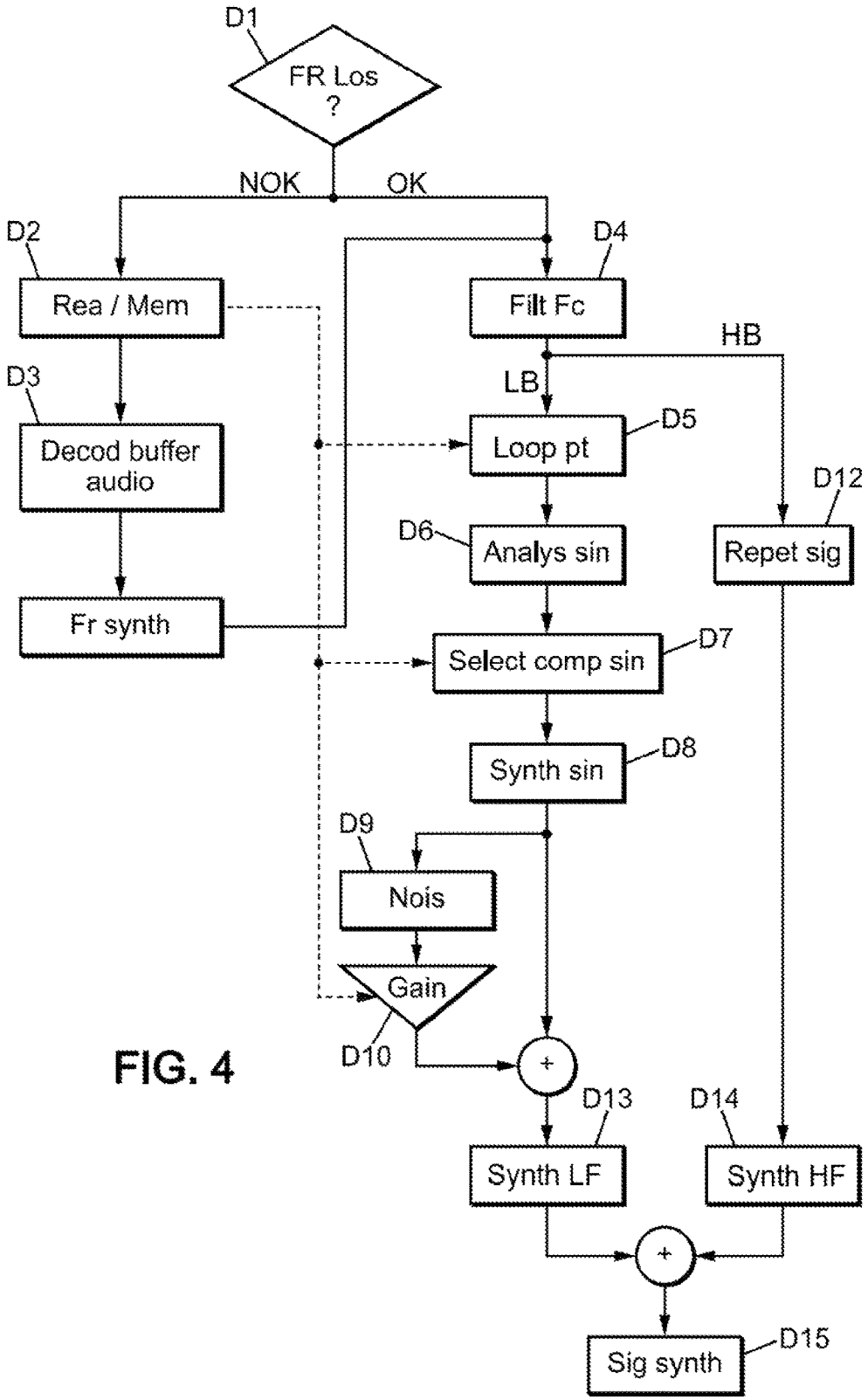
FIG. 4 shows an example of steps implemented in decoding, in one embodiment in the sense of the invention.

Referring now to FIG. 4, we will describe the steps implemented in the decoder in one exemplary embodiment of the invention.

In the case where there is no frame loss in step D1 (NOK arrow exiting test D1 of the FIG. 4), in step D2 the decoder reads the information contained in the bitstream, including the "frame loss characterization" information (at at least one bitrate of the codec). This information is stored in memory so it can be reused when a following frame is missing. The decoder then continues with the conventional steps of decoding D3, etc., to obtain the synthesized output frame FR SYNTH.

In the case where frame loss(es) occurs (OK arrow exiting test D1), steps D4, D5, D6, D7, D8, and D12 are applied, respectively corresponding to steps S2, S3, S4, S5, S6, and S11 of FIG. 1. However, a few changes are made concerning steps S3 and S5, respectively steps D5 (searching for a loop point for the pitch determination) and D7 (selecting sinusoidal components). Furthermore, the noise injection in step S7 of FIG. 1 is carried out with a gain determination according to two steps D9 and D10 in FIG. 4 of the decoder in the sense of the invention.

In the case where the "frame loss characterization" information is known (when the previous frame has been received), the invention consists of modifying the processing of steps D5, D7, and D9-D10, as follows.

In a first embodiment, the "frame loss characterization" information is binary, of a value:

equal to 0 for an unvoiced signal, of a type such as music or transient, equal to 1 otherwise (the above table).

Figure 5:
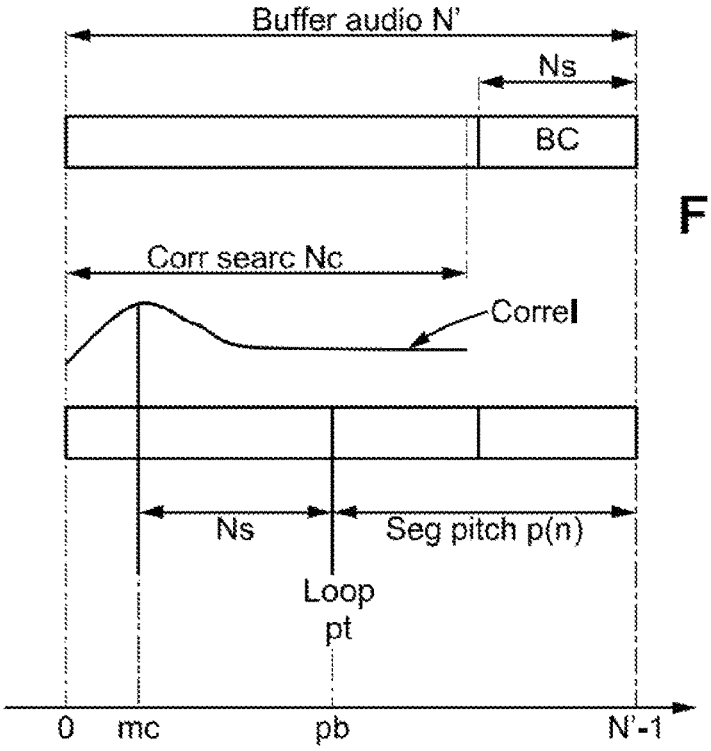
FIG. 5 illustrates an example of steps implemented in decoding, for the pitch search in a valid signal segment Nc.

Step D5 consists of searching for a loop point and a segment p(n) corresponding to the pitch within the audio buffer resampled at frequency Fc. This technique, described in document FR 1350845, is illustrated in FIG. 5, in which:

the audio buffer in the decoder is of sample size N', the size of a target buffer BC of Ns samples is determined, the correlation search is performed over Nc samples the correlation curve "Correl" has a maximum at mc, the loop point is designated Loop pt and is positioned at Ns samples of the correlation maximum, the pitch is then determined over the p(n) remaining samples at N'−1.

In particular, we calculate a normalized correlation corr (n) between the target buffer segment of size Ns, between N'−Ns and N'−1 (of a duration of 6 ms for example), and the sliding segment of size Ns which begins between sample 0 and Nc (where Nc>N'−Ns):

$$\mathrm{Corr}(n) = \frac{\sum_{k=0}^{k=Ns} b(n+k)b(N'-Ns+k)}{\sqrt{\sum_{k=0}^{k=Ns} b(n+k)^2 \sum_{k=0}^{k=Ns} b(N'-Ns+k)^2}} \quad n \in [0; Nc]$$

For music signals, due to the nature of the signal, the value Nc does not need to be very large (for example Nc=28 ms). This limitation saves in computational complexity during the pitch search.

However, voice information from the last valid frame previously received allows determining whether the signal to be reconstructed is a voiced speech signal (mono pitch). It is therefore possible, in such cases and with such information, to increase the size of segment Nc (for example Nc=33 ms) in order to optimize the pitch search (and potentially find a higher correlation value).

In step D7 in FIG. 4, sinusoidal components are selected such that only the most significant components are retained. In one particular embodiment, also presented in document FR 1350845, the first selection of components is equivalent to selecting amplitudes A(n) where A(n)>A(n−1) and $$A(n) > A(n+1) \text{ with } n \in \left[0; \frac{P'}{2} - 1\right].$$

In the case of the invention, it is advantageously known whether the signal to be reconstructed is a speech signal (voiced or generic) and therefore has pronounced peaks and a low level of noise. Under these conditions, it is preferable to select not only the peaks (A(n) where A(n)>A(n−1) and A(n)>A(n+1) as shown above, but also to expand the selection to A(n−1) and A(n+1) so that the selected peaks represent a larger portion of the total energy of the spectrum. This modification allows lowering the level of noise (and in particular the level of noise injected in steps D9 and D10 presented below) compared to the level of the signal synthesized by sinusoidal synthesis in step D8, while retaining an overall energy level sufficient to cause no audible artifacts related to energy fluctuations.

Next, in the case where the signal is without noise (at least at low frequencies), as is the case in a generic or voiced speech signal, we observe that the addition of noise corresponding to the transformed residual r'(n) within the meaning of FR 1350845, actually degrades the quality.

Therefore the voice information is advantageously used to reduce noise by applying a gain G in step D10. Signal s(n) resulting from step D8 is mixed with the noise signal r'(n) resulting from step D9, but a gain G is applied here which is dependent on the "frame loss characterization" information originating from the bitstream of the previous frame, which is:

$$s(n) = s(n) + G * r'(n) \quad n \in \left[0; 2T + \frac{LF}{2}\right].$$

In this particular embodiment, G may be a constant equal to 1 or 0.25 depending on the voiced or unvoiced nature of the signal of the previous frame, according to the table given below by way of example:

| | Value of "frame loss characterization" bit | |
|---|---|---|
| | 0 | 1 |
| Gain G | 1 | 0.25 |

In the alternative embodiment where the "frame loss characterization" information has a plurality of discrete levels characterizing the flatness Pl of the spectrum, the gain G may be expressed directly as a function of the Pl value. The same is true for the bounds of segment Nc for the pitch search and/or for the number of peaks An to be taken into account for synthesis of the signal.

Processing such as the following can be defined as an example.

The gain G has already been directly defined as a function of the Pl value: $G(Pl)=2^{Pl}$ In addition, the Pl value is compared to an average value −3 dB, provided that the 0 value corresponds to a flat spectrum and −5 dB corresponds to a spectrum with pronounced peaks.

If the Pl value is less than the average threshold value −3 dB (thus corresponding to a spectrum with pronounced peaks, typical of a voiced signal), then we can set the duration of the segment for the pitch search Nc to 33 ms, and we can select peaks A(n) such that A(n)>A(n−1) and A(n)>A(n+1), as well as the first neighboring peaks A(n−1) and A(n+1).

Otherwise (if the Pl value is above the threshold, corresponding to less pronounced peaks, more background noise, such as a music signal for example), the duration Nc can be chosen to be shorter, for example 25 ms, and only the peaks A(n) are selected that satisfy A(n)>A(n−1) and A(n)>A(n+1).

The decoding can then continue by mixing noise for which the gain is thus obtained with the components selected in this manner, to obtain the synthesis signal in the low frequencies in step D13, which is added to the synthesis signal in the high frequencies that is obtained in step D14, in order to obtain the general synthesis signal in step D15.

Figure 6:
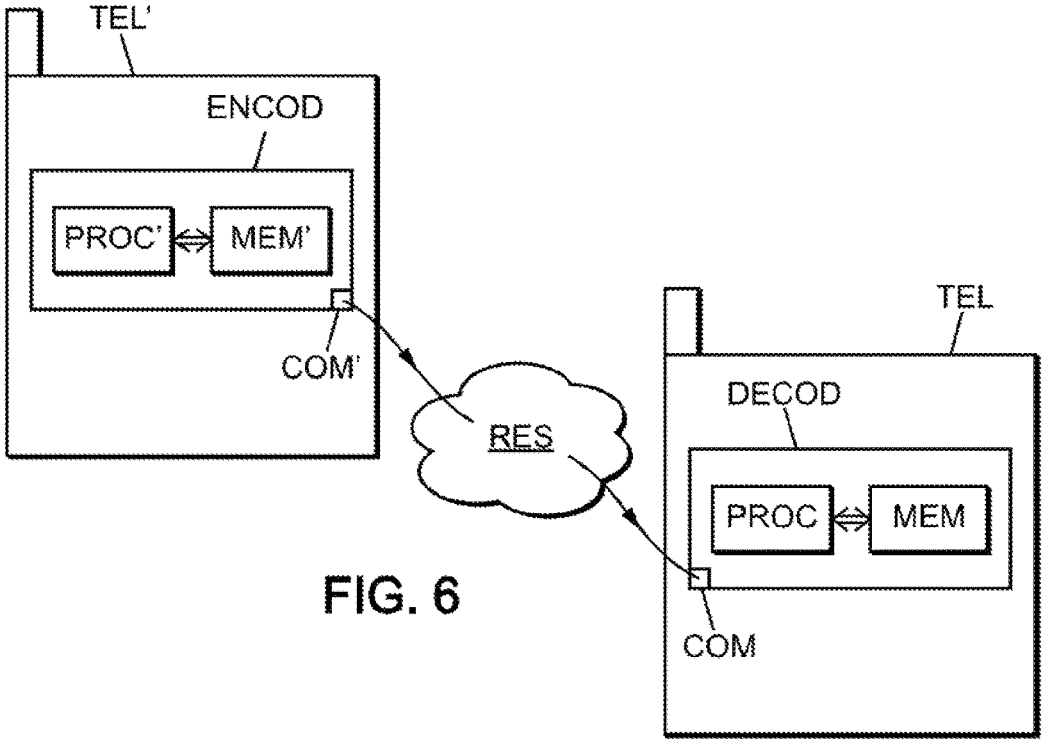
FIG. 6 schematically illustrates an example of encoder and decoder devices in the sense of the invention.

Referring to FIG. 6, one possible implementation of the invention is illustrated in which a decoder DECOD (comprising for example software and hardware such as a suitably programmed memory MEM and a processor PROC cooperating with this memory, or alternatively a component such as an ASIC, or other, as well as a communication interface COM) embedded for example in a telecommunications device such as a telephone TEL, for the implementation of the method of FIG. 4, uses voice information that it receives from an encoder ENCOD. This encoder comprises, for example, software and hardware such as a suitably programmed memory MEM' for determining the voice information and a processor PROC' cooperating with this memory, or alternatively a component such as an ASIC, or other, and a communication interface COM'. The encoder ENCOD is embedded in a telecommunications device such as a telephone TEL'.

Of course, the invention is not limited to the embodiments described above by way of example; it extends to other variants.

Thus, for example, it is understood that voice information may take different forms as variants. In the example described above, this may be the binary value of a single bit (voiced or not voiced), or a multi-bit value that can concern a parameter such as the flatness of the signal spectrum or any other parameter that allows characterizing voicing (quantitatively or qualitatively). Furthermore, this parameter may be determined by decoding, for example based on the degree of correlation which can be measured when identifying the pitch period.

An embodiment was presented above by way of example which included a separation, into a high frequency band and a low frequency band, of the signal from preceding valid frames, in particular with a selection of spectral components in the low frequency band. This implementation is optional, however, although it is advantageous as it reduces the complexity of the processing. Alternatively, the method of frame replacement with the assistance of voice information in the sense of the invention can be carried out while considering the entire spectrum of the valid signal.

An embodiment was described above in which the invention is implemented in a context of transform coding with overlap add. However, this type of method can be adapted to any other type of coding (CELP in particular).

It should be noted that in the context of transform coding with overlap add (where typically the synthesis signal is constructed over at least two frame durations because of the overlap), said noise signal can be obtained by the residual (between the valid signal and the sum of the peaks) by temporally weighting the residual. For example, it can be weighted by overlap windows, as in the usual context of encoding/decoding by transform with overlap.

It is understood that applying gain as a function of the voice information adds another weight, this time based on the voicing.

The invention claimed is:

1. A non-transitory computer readable medium storing a code of a computer program, wherein said computer program comprises instructions for implementing, when the program is executed by a processor, a method for processing a digital audio signal comprising a series of samples distributed in successive frames, the method being implemented when decoding said signal in order to replace at least one lost signal frame during decoding, the method comprising the steps of:

a) searching, in a valid signal segment available when decoding, for at least one period in the signal, determined based on said valid signal, b) analyzing the signal in said period, in order to determine spectral components of the signal in said period, c) synthesizing at least one replacement for the lost frame, by constructing a synthesis signal from:

an addition of components selected from among said determined spectral components, and noise added to the addition of components, wherein the amount of noise added to the addition of components is weighted based on voice information of the valid signal, obtained when decoding, wherein the voice information is supplied in a bitstream received in decoding and corresponding to said signal comprising a series of samples distributed in successive frames, wherein, in a case of frame loss in decoding, the voice information contained in a valid signal frame preceding the lost frame is used, wherein the voice information comes from an encoder generating the bitstream and determining the voice information, wherein the voice information is encoded in a single bit in the bitstream, wherein, in step a), the period is searched for in a valid signal segment of greater length in the case of voicing in the valid signal, and wherein:

if the signal is voiced, the period is searched for in a valid signal segment of a duration of more than 30 milliseconds, and if not, the period is searched for in a valid signal segment of a duration of less than 30 milliseconds.

2. The non-transitory computer readable medium according to claim 1, wherein the noise signal is obtained by a residual between the valid signal and the addition of selected components.

3. The non-transitory computer readable medium according to claim 1, wherein a number of components selected for the addition is larger in the case of voicing in the valid signal than in the case of unvoicing in the valid signal.

4. The non-transitory computer readable medium according to claim 1, wherein, in step a), the period is searched for in a valid signal segment of greater length in the case of voicing in the valid signal than in the case of unvoicing in the valid signal.

5. The non-transitory computer readable medium according to claim 1, wherein a noise signal added to the addition of components is weighted by a smaller gain in the case of voicing in the valid signal, and, if the signal is voiced, a gain value is 0.25, and otherwise is 1.

6. The non-transitory computer readable medium according to claim 1, wherein the voice information comes from an encoder determining a spectrum flatness value, obtained by comparing amplitudes of the spectral components of the signal to a background noise, said encoder delivering said value in binary form in the bitstream.

7. The non-transitory computer readable medium according to claim 6, wherein a noise signal added to the addition of components is weighted by a smaller gain in the case of voicing in the valid signal than in the case of unvoicing signal, and a gain value is determined as a function of said flatness value.

8. The non-transitory computer readable medium according to claim 6, wherein said flatness value is compared to a threshold in order to determine:

that the signal is voiced if the flatness value is below the threshold, and that the signal is unvoiced otherwise.

9. The non-transitory computer readable medium according to claim 1, wherein a number of components selected for the addition is larger in the case of voicing in the valid signal, and wherein:

if the signal is voiced, the spectral components having amplitudes greater than those of the neighboring first spectral components are selected, as well as the neighboring first spectral components, and otherwise only the spectral components having amplitudes greater than those of the neighboring first spectral components are selected.

10. The non-transitory computer readable medium according to claim 1, wherein a noise signal added to the addition of components is weighted by a smaller gain in the case of voicing in the valid signal than in the case of unvoicing in the valid signal.

11. A device for decoding a digital audio signal comprising a series of samples distributed in successive frames, the device comprising a computer circuit for replacing at least one lost signal frame, by:

a) searching, in a valid signal segment available when decoding, for at least one period in the signal, determined based on said valid signal, b) analyzing the signal in said period, in order to determine spectral components of the signal in said period, c) synthesizing at least one frame for replacing the lost frame, by constructing a synthesis signal from:

an addition of components selected from among said determined spectral components, and noise added to the addition of components, the amount of noise added to the addition of components being weighted based on voice information of the valid signal, obtained when decoding wherein the voice information is supplied in a bitstream received in decoding and corresponding to said signal comprising a series of samples distributed in successive frames, wherein, in a case of frame loss in decoding, the voice information contained in a valid signal frame preceding the lost frame is used, wherein the voice information comes from an encoder generating the bitstream and determining the voice information, wherein the voice information is encoded in a single bit in the bitstream, wherein, in step a), the period is searched for in a valid signal segment of greater length in the case of voicing in the valid signal, and wherein:

if the signal is voiced, the period is searched for in a valid signal segment of a duration of more than 30 milliseconds, and if not, the period is searched for in a valid signal segment of a duration of less than 30 milliseconds.

* * * * *